United States Patent [19]

Mincey

[11] Patent Number: 4,482,184

[45] Date of Patent: Nov. 13, 1984

[54] PORTABLE FOLDING CHAIR

[76] Inventor: Christopher D. Mincey, 6811 E. Ocean Blvd., Long Beach, Calif. 90803

[21] Appl. No.: 419,139

[22] Filed: Sep. 17, 1982

Related U.S. Application Data

[63] Continuation-in-part of Ser. No. 338,089, Jan. 8, 1982, abandoned.

[51] Int. Cl.[3] ..... A47C 4/00

[52] U.S. Cl. ..... 297/28; 297/47; 297/349; 297/378

[58] Field of Search ..... 297/39, 40, 46, 47, 297/27, 28, 31, 38, 16, 378, 379, 349; 248/421, 425

[56] References Cited

U.S. PATENT DOCUMENTS

| | | | |
|---|---|---|---|
| 177,526 | 5/1876 | Lawrence | 297/345 |
| 2,195,507 | 4/1940 | Best | 248/421 |
| 2,201,964 | 5/1940 | Blank | 297/27 |
| 2,282,270 | 5/1942 | Vallone | 297/359 |
| 2,708,962 | 5/1955 | Rechler | 297/31 |
| 2,788,843 | 4/1957 | Gerson | 248/425 |
| 3,718,365 | 2/1973 | Gibson | 297/349 |

FOREIGN PATENT DOCUMENTS

| | | | |
|---|---|---|---|
| 547406 | 5/1956 | Belgium | 297/39 |
| 491580 | 3/1953 | Canada | 297/39 |
| 1135786 | 8/1962 | Fed. Rep. of Germany | 297/345 |
| 215034 | 5/1941 | Switzerland | 297/28 |
| 503866 | 4/1939 | United Kingdom | 297/28 |

*Primary Examiner*—William E. Lyddane
*Assistant Examiner*—Mark W. Binder
*Attorney, Agent, or Firm*—Allan M. Shapiro

[57] ABSTRACT

Chair support pivotably carries parallelogramic support arms which are pivoted to seat rails. One of the support arms continues above the seat rail to become an arm support and adjacent the top thereof carries one end of a telescoping unit. The other end of the telescoping unit is pivoted to the seat rail. The telescoping unit is of such length that, when the support arms are in the erected position, the telescoping unit bottoms out to become a rigid compression member and provide a firm, erected position.

9 Claims, 4 Drawing Figures

FIG. 1
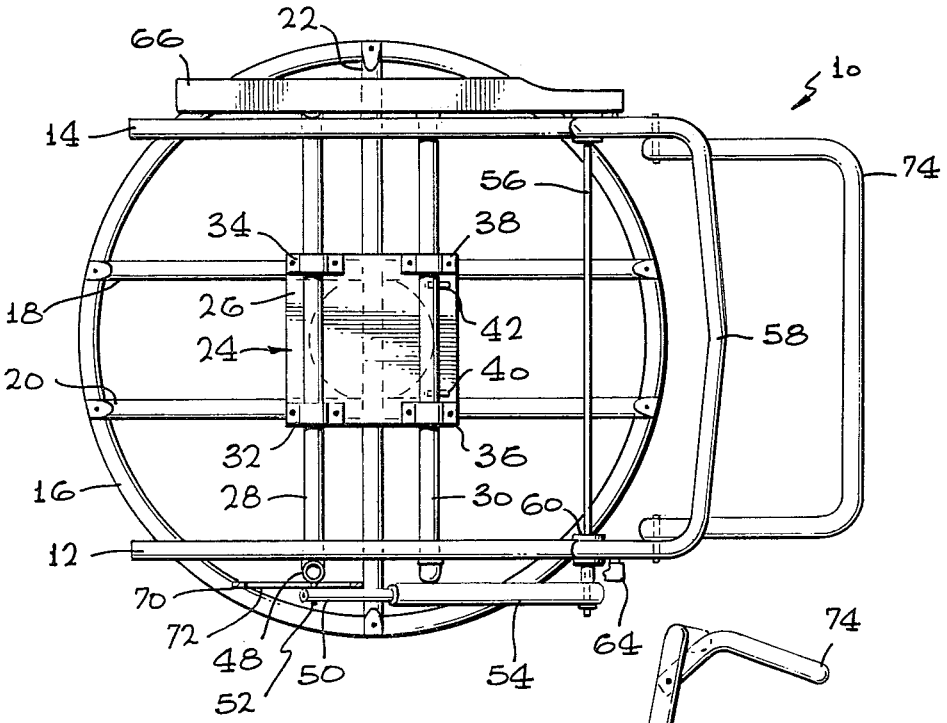
FIG. 2
FIG. 4
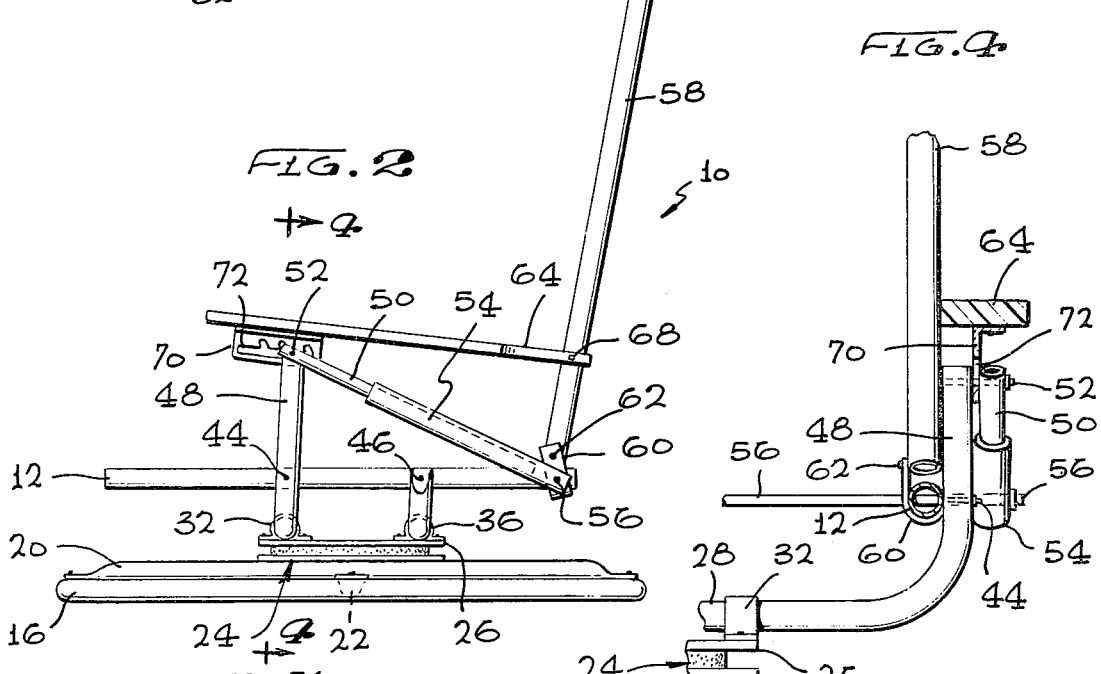
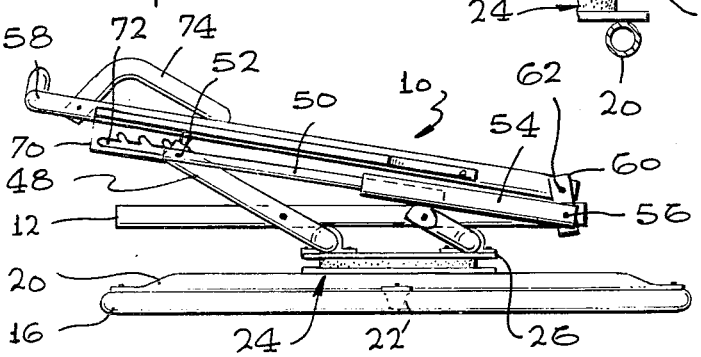
FIG. 3

PORTABLE FOLDING CHAIR

CROSS REFERENCE

This application is a continuation-in-part of my prior application for "Unupholstered Beach Chair," Ser. No. 338,089, filed Jan. 8, 1982, now abandoned.

BACKGROUND OF THE INVENTION

This invention is directed to a portable folding chair and particularly a portable folding chair which is strong when erected, easily folded, and conveniently portable. The portable folding chair may be mounted on a swivel base to enhance the utilization of the portable folding chair.

Folding chairs are known. They are often in the form of beach chairs which can be conveniently carried to the beach or other recreational location so they can be erected and provide comfortable body support during sedentary periods. The conventional portable beach chairs which have been available are comfortable, but sometimes are not strong in the erected position. In addition, they lack the opportunity for swiveling, which limits their value in summer recreational activities, such as sunning, watching ballgames, and observing the passing scene. Therefore, it is desirable to provide a portable folding chair with a strong mechanism which is subject to convenient folding and which can carry therein a suitable swivel for permitting the chair to be used as a swivel chair.

SUMMARY OF THE INVENTION

In order to aid in the understanding of this invention, it can be stated in essentially summary form that it is directed to a portable folding chair with an improved folding mechanism and which preferably includes a swivel support integrated within the folding chair mechanism.

It is, thus, an object of this invention to provide a portable folding chair which is strong in the erected position, is easily folded, and is conveniently portable so that the user can carry the chair with him and unfold it where he desires to sit.

It is a further object of this invention to provide a portable folding chair which can be mounted upon a swivel so that it has a swiveling support feature.

It is another object to provide a portable folding chair of such design and construction that it is economic to manufacture and light to carry, but is of substantial strength for a long, trouble-free life.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a plan view of the portable folding chair of this invention, in the erected position.

FIG. 2 is a side-elevational view thereof.

FIG. 3 is a similar side-elevational view, showing the portable folding chair in the almost fully folded position.

FIG.4 is an enlarged sectional view, taken generally along the line 4—4 of FIG. 2, with parts broken away.

DESCRIPTION OF THE PREFERRED EMBODIMENT

The portable folding chair of this invention is generally indicated at 10 in FIGS. 1, 2 and 3. The basic structure for the chair are the left and right seat rails 12 and 14 which are straight, cylindrically tubular rails. They are spaced apart to hold suitable material on which the user can sit and, when in the erected position, are held above the ground at a comfortable seating height.

Base ring 16 is a circular, tubular ring crossed by base tubes 18, 20 and 22. The base ring and its base tubes present a sufficient area so that the portable folding chair can be set in the sand and be adequately supported. The preferred embodiment of the chair 10 of this invention includes a swivel 24 which is secured down to the base tubes 18 and 20. The upper plate of swivel 24 is chair support plate 26 to which the upper part of the chair is secured. Without employing the swivel 24, chair support plate 26 could be secured directly onto base tubes 18 and 20.

Front and rear support arms 28 and 30 are strapped down onto chair support plate 26. As is seen in FIG. 1, swivel straps 32, 34, 36 and 38 are arranged so that swivel straps 32 and 34 hold down the long, straight central part of the U-shaped chair support 28 to the chair support plate 26. However, the swivel straps are sufficiently loose that the round bar of the chair support 28 can rotate within their embrace. Furthermore, swivel straps 36 and 38 engage around the straight central portion of the U-shaped chair support 30 to strap it in place and permit it to rotate. In addition, stop pins 40 and 42 limit the clockwise rotation of U-shaped chair support 30 to the angle shown in FIG. 2 and limit its endwise motion.

Left seat rail 12 is pivoted on pins 44 and 46, see FIG. 2, to the U-shaped chair supports 28 and 30 at equal distances above the swivel straps which define the lower pivot axis of the chair supports. Similarly, right seat rail 14 is pivotably mounted on the other end of the U-shaped chair support so that the two seat rails lie parallel to each other. With this construction, natural or synthetic straps can be secured between the seat rails to directly support a sedentary person or support a seat cushion.

Arm support 48 is an upward continuation of the near arm of U-shaped chair support 28. A similar arm support extends upward on the other end of the chair support 28. This extension is above the pivot 44 so that the arm support 48 swings upward with chair support 28. Inner telescope member 50 is pivoted on pivot pin 52, see FIGS. 2 and 4, which extends through arm support 48 adjacent its top. Outer telescope member 54 is pivoted adjacent its lower end on seat rod 56, which extends through the lower telescope member adjacent its lower end. The length of the inner and outer telescope members 50 and 54 are such that, in the folded condition (see FIG. 3), the inner telescope member is not pulled from the outer telescope member and, in the chair-erected position of FIGS. 1, 2 and 4, the inner telescope member bottoms out in member 54 on seat rod 56. This acts as a stop in the erecting direction and acts at substantially the same time that stop pins 40 and 42 engage upon chair support plate 26. In the erected condition, the left seat rail 12, arm support 48, and the telescope form a rigid structure against movement in the clockwise direction of arm support 48 around its pivot pin 44. Such rigidizes the portable folding chair 10 in its erected position. Since arm support 48 and chair support 28 are the same tube, the erected position of the seat rails above base ring 16 is firmly controlled. Seat rod 56 can cooperate with the webbing and/or upholstery to provide the seat support.

Chair back 58 is in the form of an inverted cylindrical tube bent into U-shaped configuration. A pair of U-brackets, one of which is indicated at 60 in FIGS. 2, 3 and 4, embrace the seat rails adjacent their back ends where the seat rod 56 passes therethrough. U-bracket 60 is shown embracing the rear end of left seat rail 12, while the other U-bracket is similarly positioned at the rear end of right seat rail 14. The downwardly directed arms of U-shaped chair back 58 are engaged between the arms of the U-brackets. A pivot pin 62 engages through each of the U-brackets and through the lower ends of the arms of chair back 58. The U-bracket 60 permits the chair back to lie forward directly over seat rails 12 and 14.

Arms 64 and 66 are pivoted at their rear ends on the downwardly directed arm portions of chair back 58, respectively on the left and right sides, and are secured by pivot pins, with the left pivot pin 68 on the back of the left arm 64 being shown in FIG. 2. Adjustment brackets are secured under each of the arms and are positioned between the inner telescope member and the arm support. Adjustment bracket 70 is shown as an L-shaped plate secured under left arm 64. The adjustment bracket has a slot 72 therein which engages around the pivot pin 52 which pierces the upper end of inner telescoping member 50, see FIG. 4. As is seen in FIGS. 2 and 3, the slot 72 has a series of teeth therein which can selectively engage against pivot pin 52 to selectively position the angle of chair back 58. Slot 72 is sufficiently long that the chair back can swing all the way forward into the folded position where it lies directly over and parallel to the left and right seat rails 12 and 14 in the folded position and, in the opposite direction, chair back 58 can lie substantially horizontal, parallel to the plane of the left and right seat rails. This is the position of maximum recumbency in which chair back support 74 can be swung out to provide additional support for the most extended portion of chair back 58. Chair back support 74 thus provides additional support for this extended portion of the back to permit secure recumbency upon the chair 10.

When the adjustment brackets 70 are engaged on pivot pin 52 on one of their intermediate teeth, the chair back 58 is held in one of a selected group of sitting positions, such as that shown in FIGS. 1 and 2. In the sitting position, the chair 10 can comfortably support the person and permit him to swivel. Folding the chair 10 is easy because, with a single stroke the chair back 58 is pulled forward to swing the chair back 58 down onto the left and right seat rails. This same force causes withdrawal of the inner telescoping member up from its stop so that the parallelogramic chair supports 28 and 30 swing to the left toward and folded position. In the folded position, chair supports 28 and 30 are nearly horizontal and parallel to base ring 60, and the seat rails lie against the lower cross pieces of the chair supports 28 and 30. In this position, the chair 10 is compact. When the chair 10 is made of aluminum tube, the chair is lightweight and, in the compact, folded position, can easily be picked up and carried. The compactness of the folded chair is also convenient for its storage.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A portable folding chair comprising:

a support;

front and rear U-shaped chair supports each having a substantially straight cross piece and upwardly directed arms, said substantially straight cross pieces being pivotably mounted on said support and pivoting on an axis substantially parallel to each other;

left and right seat rails each pivoted to one upwardly extending arm of each of said front and rear U-shaped chair supports so that said support, said chair supports and said seat rails substantially form a pivoting parallelogram;

an arm support extending upward from said front chair support and firmly connected thereto;

inner and outer telescoping members, one of said telescoping members being pivoted to said arm support and the other of said telescoping members being pivoted to the seat rail on the same side of said chair, said telescoping members being of such length as to permit said arm supports to pivot forward to close the parallelogram in the forward, folded direction and to stop motion of the parallelogram in the chair-erected position wherein said seat rails are spaced away from said support.

2. The chair of claim 1 wherein said telescoping members are tubular members with said outer telescoping member having a pivot pin therethrough and said inner telescoping member engaging against said pivot pin when said chair is in its erected position.

3. The portable folding chair of claim 2 wherein said support is a swivel support having a base ring thereunder so that said chair support can swivel on said base ring on a substantially upright axis.

4. The chair of claim 2 further including a chair back, U-brackets mounted on said seat rail and extending upward therefrom, said chair back being pivoted on said U-brackets so that said chair back can pivot forward and lie over said seat rails.

5. The chair of claim 4 wherein a chair back support is provided under said chair back to support the portion of said chair back away from said U-bracket when said chair back is in a recumbent position.

6. The chair of claim 4 wherein an arm is pivoted to said back above said U-bracket, said arm carrying an adjustable bracket thereon, said adjustable bracket having a slot therein and said slot embracing a pivot pin interconnecting said telescoping member and said arm support so that said back can be held in selected angular positions with respect to said seat rail by engagement of said pivot pin in said slot.

7. The portable folding chair of claim 6 wherein said support is a swivel support having a base ring thereunder so that said chair support can swivel on said base ring on a substantially upright axis.

8. The chair of claim 2 wherein a seat rod interconnects said seat rails adjacent the rear thereof, said seat rod being said pivot pin through said outer telescoping member, said seat rod being for interconnecting said seat rails and being for supporting seating material.

9. The portable folding chair of claim 8 wherein said support is a swivel support having a base ring thereunder so that said chair support can swivel on said base ring on a substantially upright axis.

* * * * *